United States Patent [19]

Everett

[11] Patent Number: 4,804,291

[45] Date of Patent: Feb. 14, 1989

[54] DOUBLE GIMBAL CAMLOCK INSTALLATION ASSEMBLY

[75] Inventor: James W. Everett, New Stanton, Pa.

[73] Assignee: Sumitomo Electric Industries, Ltd., Osaka, Japan

[21] Appl. No.: 26,363

[22] Filed: Mar. 16, 1987

[51] Int. Cl.[4] ..... B25G 3/00

[52] U.S. Cl. ..... 403/287; 403/58; 403/74

[58] Field of Search ..... 403/74, 73, 72, 58, 403/104, 372, 287; 248/182; 165/11.2, 76; 411/34

[56] References Cited

U.S. PATENT DOCUMENTS

| | | | |
|---|---|---|---|
| 2,188,793 | 1/1940 | Newbold | 53/5 |
| 2,542,967 | 2/1951 | Waechter | 411/34 X |
| 2,885,565 | 5/1959 | Davis | 250/231 |
| 2,999,706 | 9/1961 | Wilcox | 403/370 |
| 4,427,317 | 1/1984 | Wilhelm | 403/31 |
| 4,451,198 | 5/1984 | Sanderson | 414/779 |
| 4,452,654 | 6/1984 | KaDell, Jr. | 156/91 |
| 4,545,570 | 10/1985 | KaDell, Jr. | 156/91 |
| 4,649,989 | 3/1987 | Vermaat et al. | 403/16 X |

FOREIGN PATENT DOCUMENTS

| | | | |
|---|---|---|---|
| 613232 | 11/1948 | United Kingdom | 411/34 |

*Primary Examiner*—Andrew V. Kundrat

*Attorney, Agent, or Firm*—Sughrue, Mion, Zinn, Macpeak, and Seas

[57] ABSTRACT

A device for installing a screw-driven, expandable camlock mechanism in a steam generator host tube to effectuate inspections of or repairs to a steam generator tube or tube sheet is disclosed herein. The device comprises a double gimbal camlock installation assembly capable of vertically aligning the camlock mechanism, which has a deformable sleeve disposed thereon, with a steam generator host tube and capable of installing the camlock mechaism in the steam generator host tube. The installation assembly includes a double gimbal having a pivotal first ring disposed in and connected to a pivotal second ring which is disposed between and connected to the tines of a U-shaped fork. Attached to the first ring is a housing having a rotation device disposed therein, which rotation device engages a threaded rod that is connected to the camlock mechanism. When the rotation device is actuated, the rod is rotated such that the camlock mechanism causes the deformable sleeve to elastically deform and engage the inside surface of the steam generator host tube. Repair tools are attached to the installation assembly for repairing the steam generator tube and tube sheet. Following the repair, the repair tools are removed from the installation assembly and the rotation device is reactuated so that the sleeve is disengaged from the inside surface of the steam generator host tube. The camlock mechanism is then removed from the steam generator host tube.

27 Claims, 5 Drawing Sheets

DOUBLE GIMBAL CAMLOCK INSTALLATION ASSEMBLY

BACKGROUND OF THE INVENTION

This device relates to a gimbal camlock installation asembly and more particularly to a double gimbal camlock installation assembly ahving a screw-driven, expandable camlock mechanism capable of gripping the inside surface of a tubular member, such as anuclear reactor steam generator tube for effectuating the inspection and repair of steam generator tubes and tube sheets.

A nuclear reaction is a device for producing heat by the controlled fission of nuclear material such as uranium or plutonium-bearing compounds. The nuclear material is contained in a reactor core which is disposed in a sealed primary coolant piping loop. A primary fluid, such as water, flows in the primary coolant piping loop for cooling the reactor core. In addition to the primary coolant piping loop, the nuclear reactor further comprises a secondary coolant piping loop in which flows a secondary fluid such as water. Heat, due to the fissioning of the nuclear material in the reactor core, is transferred by conduction from the core to the primary fluid flowing in the primary coolant piping loop. The heat due to fission is then transferred by conduction to the secondary fludi by using a heat exchanger device commonly referred to in the art as a steam generator. As described presently, the steam generator is in heat transfer communication with the primary and secondary fluids flowing in the primary and secondary coolant piping loops respectively.

As mentioned above, the steam generator is a heat exchanger device which transfers heat from the primary coolant piping loop to the secondary coolant piping loop. Disposed in the typical steam generator are a plurality of vertical, inverted U-shaped steam generator tubes through which flows the primary fluid. In heat transfer communication with the exterior surfaces of the tubes is the secondary fluid. Heat is transferred by conduction from the primary fluid to the secondary fluid through each tube wall. The primary fluid is recirculated through the primary coolant piping loop while the secondary fluid is ultimately circulated to a heat sink thereby transferring heat from the primary fluid to the heat sink. Typcially, the plurality of tubes are connected to a plurality of steam generator tube support plates which are disposed in the steam generator at various locations along the length of the tubes for supporting the tubes and for reducing flow-induced vibration in the tubes. The ends of the tubes may be disposed in a plurality of vertical apertures that are formed in a tube sheet. Moreover, the primary fluid is radioactive; therefore, the steam generator is designed such that the primary fluid is nowhere in direct fluid communication with the secondary fluid.

Occasionally, it is necessary to inspect and repair the tubes or the tube sheet to maintain the complete separation of the primary and secondary fluids. A camlock apparatus may be utilized to effectuate such inspections and repairs. The camlock apparatus is installed in the end of a selected vertical steam generator host tube and an inspection or repair tool may be then attached to the camlock apparatus. The tool is used to inspect or repair a tube or tube sheet. Following the inspection or repair, the inspection or repair tool is detached from the camlock apparatus and the camlock apparatus is retrieved from the host tube. However, before the camlock apparatus may be installed in the host tube, it is preferred that the camlock apparatus first be vertically aligned with the host tube so that it may be efficiently installed in the host tube.

There are several devices known in the art for aligning and pivoting an element. One such device is disclosed by U.S. Pat. No. 4,451,198 issued May 29, 1984 in the name of Edward T. Sanderson and entitled "Material Handling Device". This patent discloses an attachment device for providing a gimbal-type pivoting arrangement whereby a coil of flat material, such as coiled steel, can be transported, picked up and released in either a horizontal or vertical plane. However, this attachment device is inappropriate for deployment in a typical steam generator to inspect or repair steam generator tubes or tube sheets because this attachment device allows pivoting of the element only in one arc for bringing the element to a vertical position. Therefore, this attachment device does not allow for pivoting in either of two mutually perpendicular arcs. Pivoting in either of two mutually perpendicular arcs is preferred when a camlock apparatus is used for inspecting or repairing steam generator tubes or tube sheets.

Another device known in the art that utilizes a gimbal-type device for aligning and rotating an element is disclosed by U.S. Pat. No. 2,188,793 issued Jan. 30, 1940 in the name of Thomas Jefferson Newbold and entitled "Heat Treating Device". This patent discloses a device having a holder for subjecting elements to heat of a fire or flame while held in the hand of the user at a point remote from the heat. This device provides a handle and material-holding mechanism connected therewith by means of a universally flexible joint, coupling, or connection, so that any desired side of the material-holder may be presented to the heat without change of the direction of the axis of the handle. However, this device is not capable of properly installing a camlock apparatus in a steam generator tube due at least in part to this device being rotatable only about the vertical axis of the flexible joint. Consequently, this device is not capable of pivoting in two mutually perpendicular arcs which is preferred when inspecting or repairing a steam generator tube or tube sheet.

A device typical of the art of expandable camlocks is disclosed by U.S. Pat. No. 4,427,317 issued Jan. 24, 1984 in the name of John J. Wilhelm and entitled "Expandable Camlock" which is assigned to the Westinghouse Electric Corporation. This device employs a camlock for engaging the inside of a tubular member and for suspending apparatus from the tubular member for inspecting or repairing a steam generator tube or tubesheet. However, this patent does not disclose the use of a gimbal-type device for vertically aligning the camlock with a host tube.

Consequently, while the prior art disclosed gimbal-type devices for aligning an element and disclosed devices for installing camlocks in steam generator tubes, the prior art did not disclose a device which combined a gimbal-type device and a camlock for effectuating the inspection or repair of steam generator tubes and tube sheets.

Therefore, what is needed is a double gimbal camlock installation assembly capable of pivoting in two mutually perpendicular arcs to vertically align and install a camlock apparatus in a steam generator tube for effectuating the inspection and repair of steam generator tubes and tube sheets.

SUMMARY OF THE INVENTION

A device for installing a screw-driven, expandable camlock mechanism in a steam generator tube to effectuate inspections of and repairs to a steam generator tube or rube sheet is disclosed herein. The device comprises a double gimbal camlock installation assembly capable of vertically aligning the camlock mechanism with a steam generator host tube and capable of installing the camlock mechanism in the steam generator host tube. The installation assembly includes a double gimbal having a pivotal first gimbal disposed between and connected to the tines of a U-shaped fork and a second gimbal disposed in and connected to the first gimbal for vertically aligning the camlock mechanism with the steam generator host tube. Attached to the second gimbal is a housing having a rotation device disposed therein, which rotattion device engages a screw-threaded rod that is connected to the camlock mechanism. When the rotation device is actuated, the rod is rotated such that the camlock mechanism causes a deformable sleeve to elastically deform and engage the inside surface of the steam generator host tube. Inspection or repair tools are attached to the installation assembly for inspecting or repairing a steam generator tube or portion of the tube sheet that is located near the host tube. Following the inspection or repair, the inspection or repair tools are detached from the installation assembly and the rotation device is reactuated so that the sleeve is disengaged from the inside surface of the tube. The camlock mechanism is then retrieved from the steam generator tube.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings wherein:

DESCRIPTION OF THE PREFERRED EMBODIMENT

Occasionally, it is necessary to make inspections of or repairs to steam generator tubes or tube sheets. The invention described herein is a double gimbal camlock installation assembly capable of vertically aligning a screw-driven, expandable camlock mechanism with a selected steam generator host tube and capable of installing in the host tube a gripping means for gripping the inside surface of the host tube to effectuate inspections of or repairs to steam generator tubes and tube sheets.

Figure 1:
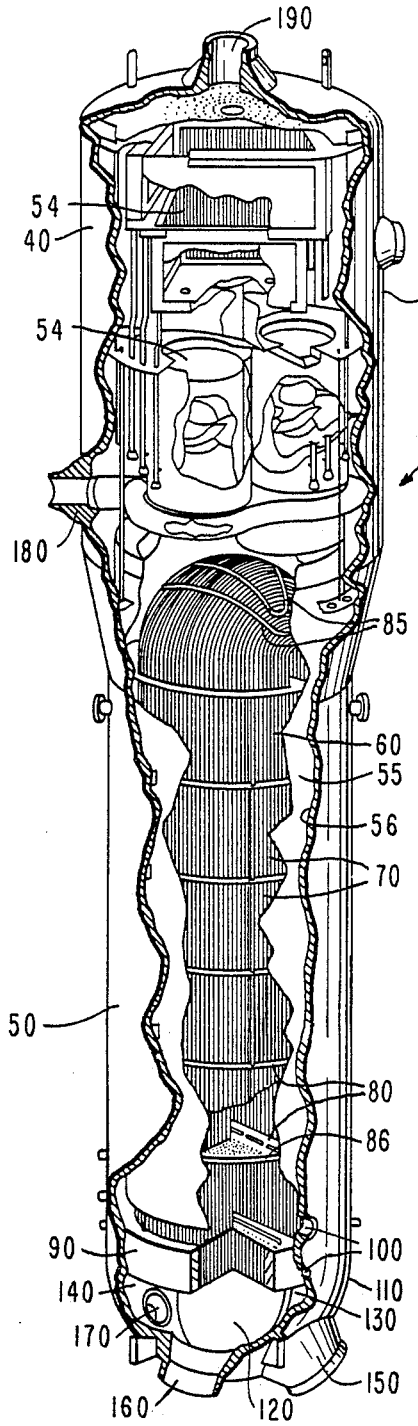
FIG. 1 is a view in perspective of a steam generator with parts removed in the interest of clarity.

Referring to FIG. 1, a steam generator is referred to generally as 20 and comprises a generally cylindrical outer shell 30, which may be manganese-moybdenum steel approximately 68 feet long and approximately 12 feet in outside diameter, having a cylindrical upper portion 40 and a generally cylindrical lower portion 50. Disposed in upper portion 40 is a moisture separating means 54 for separating a steam-water mixture so that entrained water is removed from the steam-water mixture. Disposed in lower portion 50 is an inner shell 55 which is closed at its top end except for a plurality of openings disposed in its top end for allowing passage of the steam-water mixture from inner shell 55 to moisture separating means 54. Inner shell 55 is open at its bottom end, which inner shell 55 defines an annulus 56 between inner shell 55 and outer shell 30. Disposed in inner shell 55 is a vertical steam generator tube bundle 60 having a plurality of vertical, U-shaped steam generator tubes 70, which may be thermally treated Inconel. Disposed at various locations along the length of bundle 60 are a plurality of horizontal, circular tube support plates 80, which may be Type 405 stainless steel, having holes therein for receiving each tube 70, for laterally supporting tubes 70 and for reducing flow induced vibration in tubes 70. Additional support for tubes 70 is provided in the U-bend region of bundle 60 by a plurality of anti-vibration bars 85 which may be chrome-plated Inconel.

Referring again to FIG. 1, disposed in lower portion 50 and below the bottom-most support plate 86 is a horizontal, circular tube sheet 90 having a plurality of vertical apertures 100 therethrough for receiving the ends of tubes 70, which ends of tubes 70 extend a predetermined distance through apertures 100. Tube sheet 90, which may be a nickel-molybdenum-chromiun-vanadium alloy clad in Inconel, is sealingly attached, which may be by welding, around its circumferential edge to a hemispherical channel head 110. Disposed in channel head 110 is a vertical, semi-circular divider plate 120 sealingly attached, which may be by welding, to tube sheet 90 along the flat edge of divider plate 120 and sealingly attached, which may be by welding, to channel head 110 along the circumferential edge of divider plate 120. Divider plate 120 divides channel head 110 into an inlet plenum chamber 130 and an outlet plenum chamber 140.

Again referring to FIG. 1, disposed on outer shell 30 below tube sheet 90 are a first inlet nozzle 150 and a first outlet nozzle 160 in communication with inlet plenum chamber 130 and with outlet plenum chamber 140 respectively. A primary fluid, which may be water, enters inlet plenum chamber 130 through first inlet nozzle 150 and flows through tubes 70 to outlet plenum chamber 140 where the primary fluid exits steam generator 20 through first outlet nozzle 160. A plurality of manway holes 170 are disposed in outer shell 30 below tube sheet 90 for providing access to inlet plenum chamber 130 and outlet plenum chamber 140. Disposed on shell 30 above tube bundle 60 is a second inlet nozzle 180 for allowing entry of a secondary fluid, which may be water, into upper portion 40. A second outlet nozzle 190 is disposed on the top of upper portion 40 for exit of steam from steam generator 20.

During operation of steam generator 20, the primary fluid enters inlet plenum chamber 130 through first inlet nozzle 150 and flows through tubes 70 to outlet plenum chamber 140 where the primary fluid exits steam generator 20 through first outlet nozzle 160. The secondary fluid enters upper portion 40 through second inlet nozzle 180 and then flows downwardly through annulus 56 until the secondary fluid is in fluid communication with tube sheet 90. The secondary fluid then leaves annulus 56 flowing upwardly by natural convection through bundle 60 where the secondary fluid boils and vaporizes into a steam-water mixture due to conductive heat transfer from the primary fluid to the secondary fluid through the walls of tubes 70 which comprise bundle 60. The steam-water mixture flows upwardly and is separated by moisture separating means 54 into saturated water and dry saturated steam which may obtain a minimum quality of approximately 99.75 percent. The saturated water flows downwardly from the moisture separating means 54 and mixes with the secondary fluid entering steam generator 20 through second inlet nozzle 180. The secondary fluid then enters annulus 56 as the dry saturated steam exits steam generator 20 through second outlet nozzle 190. In a mnanner well known in the art, the dry saturated steam is ultimately transported to a heat sink (not shown) after the dry saturated steam exits steam generator 20 through second outlet nozzle 190. Moreover, the primary fluid is radioactive; therefore, steam generator 20 is designed such that the primary fluid is nowhere in direct fluid communication with the secondary fluid. Occasionally, however, repairs must be made to tubes 70 or tube sheet 90 to maintain the complete separation of the primary and secondary fluids.

Figure 2:
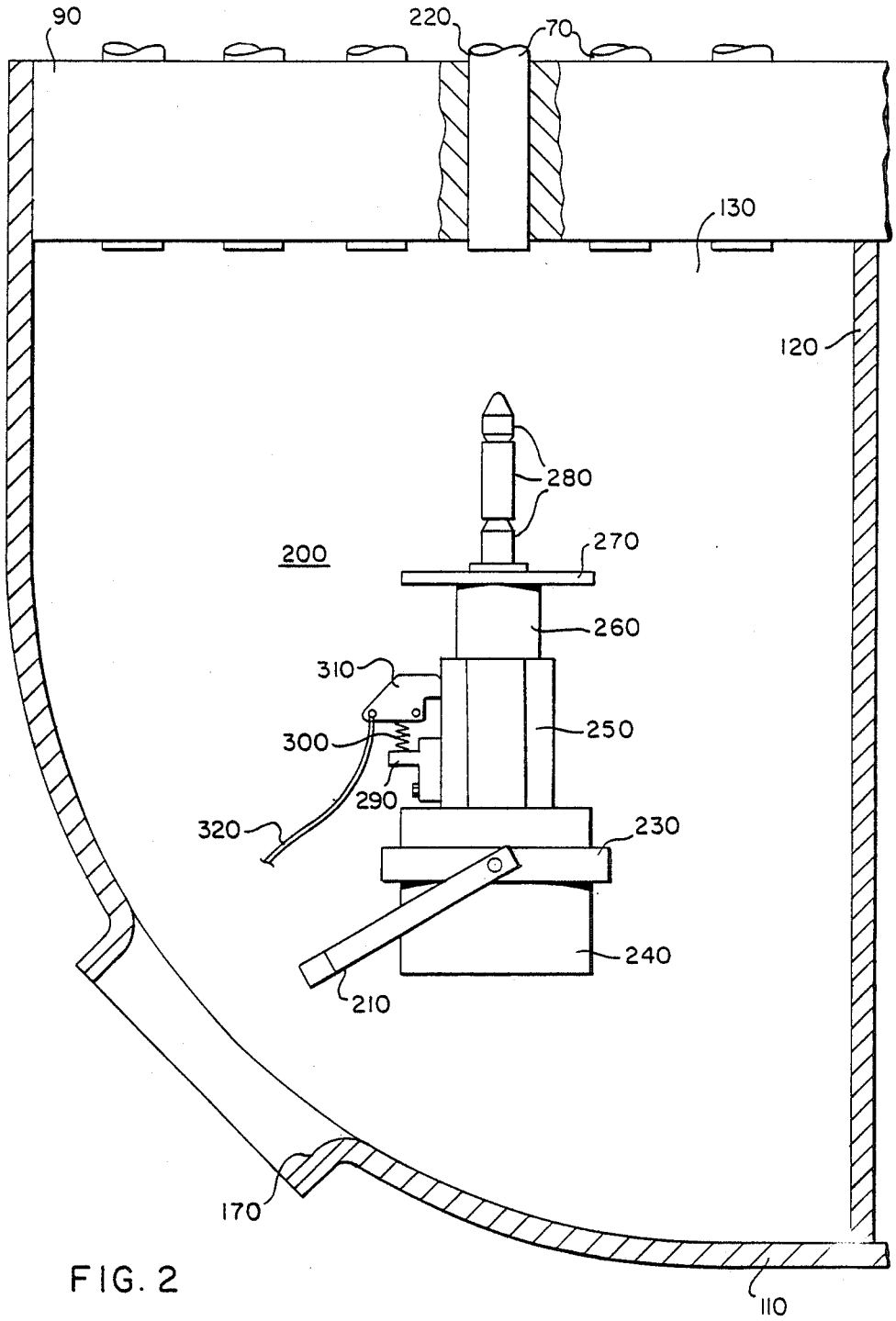
FIG. 2 is a view of a vertical section of a channel head of a steam generator illustrating a double gimbal camlock installation assembly disposed therein.

Referring now to FIG. 2, there is illustrated the subject matter of the present invention which is a double gimbal camlock installation assembly generally referred to as 200. Installation assembly 200 is capable of being used to effectuate inspections and repairs of tubes 70 and tube sheet 90 after installation assembly 200 is inserted into inlet plenum chamber 130 through hole 170 using an appropriate insertion means (not shown) such as a remote access manipulator arm. Alternatively, installation assembly 200 may be similarly inserted into outlet plenum chamber 140 to effectuate inspections and repairs of tubes 70 and tube sheet 90.

Referring again to FIG. 2, installation assembly 200 is disposed in a U-shaped fork 210 which is attached to the insertion means, which fork 210 is used to urge installation assembly 200 beneath a selected steam generator host tube 220. Host tube 220 is selected such that it is in the neighborhood of the tube 70 or the portion of tube sheet 90 requiring inspection or repair. Installation assembly 200 includes a double gimbal 230 for maintaining installation assembly 200 in substantially vertical alignment with host tube 220. The general configuration of installation assembly 200 is shown in FIG. 2. As illustrated in FIG. 2, installation assembly 200 generally includes a vertical, cylindrical rotation device housing 240 disposed in double gimbal 230 and an elongated, hexagonally-shaped vertical collet 250, which may be aluminum approximately 2.60 inches long and approximately 1.875 inches across its shortest width in cross section, mounted on the top of rotation device housing 240. Disposed in collet 250 is an elongated, generally hexagonallyshaped, vertical camlock base 260, which may be aluminum approximately 3.20 inches long and approximately 1.490 inches across its shortest width in cross section. Mounted on the top of camlock base 260 is a generally circular and horizontal, flat base plate 270 for supporting a screw-driven, expandable camlock mechanism 280 which is mounted on the top of base plate 270. Camlock mechanism 280 is capable of being installed in host tube 220 for gripping the inside surface of host tube 220. Moreover, attached to collet 250 is a latch retainer 290, which may be aluminum, for supporting an elastic metal spring 300, which may be stainless steel. Spring 300 is attached to an inverted, generally L-shaped latch 310 defined by a generally horizontal leg and a generally vertical leg integrally attached to the horizontal leg, which latch 310 may by 304 stainless steel. As described presently, latch 310 is capable of engaging camlock base 260 through collet 250 for connecting the lower portion of installation assembly 200 to the upper portion of installation assembly 200, which upper portion comprises camlock base 260, base plate 270 and camlock mechanism 280. Attached to latch 310 is a latch release 320, which may be a flexible nylon cord, an electro-mechanical apparatus, or other device for releasibly engaging latch 310 with camlock base 260. When latch release 320 is actuated, latch 310 is disengaged from camlock base 260 thereby releasing the lower portion of installation assembly 200 from the upper portion of installation assembly 200.

Figure 3:
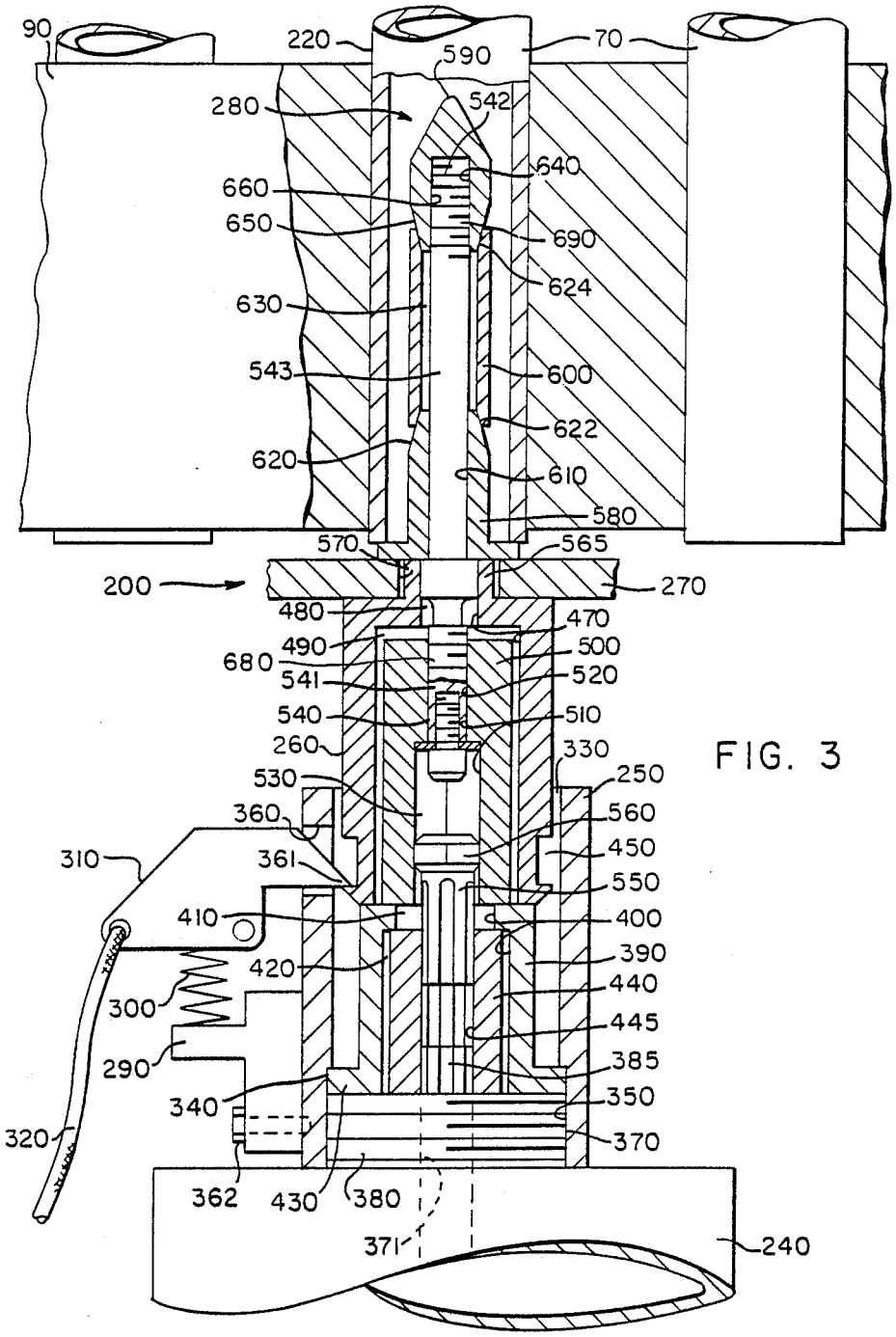
FIG. 3 is a view of a vertical section in partial elevation showing a camlock mechanism installed in a steam generator host tube.

Referring to FIG. 3, there is illustrated installation assembly 200 including collet 250, which may be aluminum, having a longitudinal first bore 330 therethrough. Formed in the lower portion of first bore 330 is a circumferential first groove 340 which may be approximately 0.260 inch in height. First groove 340 radially extends from first bore 330 to near the marginal edge of collet 250. Also formed in the lower portion of first bore 330 are a plurality of first threads 350 extending from the bottom of first groove 340 to the bottom end of first bore 330. Formed through the upper portion of collet 250 is a horizontal slot 360, which may be approximately 0.800 inch in height and approximately 0.460 inch in width, for receiving a tapered end 361 that is formed in latch 310. As indicated above, tapered end 361 extends through slot 360, which is formed through collet 250, for engaging a portion of camlock base 260. Latch 310, which is attached to spring 300, connects the upper portion of installation assembly 200 to the lower portion of installation assembly 200. Spring 300, which is attached to latch retainer 290, supports latch 310 and provides a means for automatically engaging latch 310 with a portion of camlock base 260 by the elastic action of spring 300. In addition, spring 300 urges latch 310 in an upward direction sot hat slot 360 matingly receives tapered end 361 which extends through slot 360. Latch retainer 290 is attached to collet 250 by an attachment means 362, which may be a socket head screw, for securing latch retainer 290 to collet 250.

Referring again to FIG. 3, mounted on the bottom portion of collet 250 is housing 240. Integrally formed on the top end of housing 240 is cylindrical first top post 370 having a second bore 371 therethrough. First top post 370 is recessed from the marginal edge of housing 240. Disposed on first top post 370 are a plurality of external, second threads 380 for engaging first threads 350 which are formed in the lower portion of first bore 330. Disposed in housing 240 is a rotation device (not shown) which may be A30 Series reversible air-operated motor available from Stanley Air Tools Company located in Cleveland, Ohio. Connected to the rotation device is a generally cylindrical and vertical shaft 385 which may have splines formed thereon. The shaft 385, which may be approximately 0.330 inch in diameter, vertically extends from the rotation device through second bore 371. Mounted on the top of first top post 370 is a generally cylindrical bearing 390, which may be bronze approximately 0.800 inch long and approximately 0.990 inch in outside diameter. Formed through bearing 390, which is disposed in first bore 330, is a longitudinal stepped third bore 400 having an upper first chamber 410 and a lower second chamber 420. The first chamber 410 may be approximately 0.160 inch long and approximately 0.562 inch in diameter. The second chamber 420 may be approximately 0.640 inch long and approximately 0.650 inch in diameter. Formed in the lower portion of bearing 390 is an outwardly extending, circumferential flange 430 for matingly engaging first groove 340. Also mounted on the top of first top post 370 is a generally cylindrical and vertical connector 440, such as Stanley Air Tool part number A3054 available from Stanley Air Tools Company located in Cleveland, Ohio, having a longitudinal, splined fourth bore 445 therethrough for matingly engaging the splines of shaft 385. The connector 440, which is disposed in second chamber 420, may be aluminum approximately 0.640 inch long and approximately 0.650 inch in outside diameter.

Again referring to FIG. 3, mounted on the top of bearing 390 is camlock base 260 having a circumferential second groove 450, which may be approximately 1.720 inch in height and recessed approximately 0.150 inch from the marginal edge of camlock base 260. Second groove 450 is formed in the lower portion of camlock base 260 for receiving tapered end 361. Extending through slot 360 is tapered end 361, which is formed in latch 310, for engaging tapered end 361 in second groove 450. Slot 360 is horizontally aligned with second groove 450 so that tapered end 361 may engage second groove 450. Formed through camlock base 260 is a longitudinal, stepped fifth bore 470, which fifth bore 470 has a rectangularly-shaped, upper third chamber 480 and a cylindrically-shaped, lower fourth chamber 490. The third chamber 480 may be approximately 1.210 inches long and approximately 0.502 inch on each side in cross section. The fourth chamber 490 may be approximately 1.990 inches long and approximately 1.000 inch in diameter. Mounted on the top of bearing 390 and disposed in fourth chamber 490 is a cylindrical and vertical first sleeve 500, which may be brass, having a longitudinal, stepped sixth bore 510 therethrough. Sixth bore 510 has a cylindrical, upper fifth chamber 520 and a hexagonally-shaped lower sixth chamber 530, which fifth chamber 520 has a plurality of internal third threads 540 for engaging a threaded lower end 541 of a generally circular and screwthreaded rod 543 that vertically extends from fifth chamber 530 to camlock mechanism 280. The fifth chamber 520 may be approximately 0.50 inch long and approximately 0.438 inch in diameter. The sixth chamber 530 may be approximately 1.50 inches long and approximately 0.502 inch across its shortest width in cross section.

Referring again to FIG. 3, there is illustrated the installation assembly 200 including a generally cylindrical and vertical splined key 550, which may be tempered tool steel approximately 1.25 inches long, disposed in fourth bore 445. Splined key 550 may have a hexagonally-shaped head 560, which is integrally formed in the top end of key 550 and which is approximately 0.562 inch across its shortest width in cross section for matingly engaging the hexagonally-shaped sixth chamber 530. Key 550 is attached, which may be by welding, to connector 440 for securing key 550 in bore 445. Key 550 extends from the upper portion of fourth bore 445, where the splines of key 550 matingly engage the splines of fourth bore 445, through first chamber 410 and into sixth chamber 530 where the head 560 of key 550 matingly engages sixth chamber 530. Integrally formed on the top end of camlock base 260 is a cylindrical second top post 565 having third chamber 480 extending therethrough. Mounted on the top of camlock base 260 is base plate 270 having a transverse seventh bore 570 through the center thereof for matingly engaging second top post 565. Second top post 565, which is capable of being pressed into seventh bore 570, is recessed from the marginal edge of camlock base 260 for matingly engaging seventh bore 570.

Again referring to FIG. 3, mounted on the top of base plate 270 is camlock mechanism 280 having a generally cylindrical spreader 580, a generally cylindrical guide 590, and a generally cylindrical gripping means comprising a deformable second sleeve 600. Spreader 580 is mounted on the top of base plate 270. A longitudinal, cylindrical eighth bore 610 is formed through spreader 580 which has a first frusto-conical surface 620 formed in the top surface thereof. Mounted on the first frusto-conical surface 620 is second sleeve 600 having a first beveled edge 622 formed in its lower end for matingly engaging the first frusto-conical surface 620. In addition, second sleeve 600 has a second beveled edge 624 formed in its upper end and a ninth bore 630 therethrough. Mounted on the top of second sleeve 600 is guide 590 having a longitudinal, well-shaped tenth bore 640 therein and having a second frusto-conical surface 650 formed in the bottom surface thereof for matingly engaging the second beveled edge 624 forme din the upper end of second sleeve 600. Formed in tenth bore 640 are a plurality of fourth threads 660 for engaging the threaded upper end 542 of rod 543. The rod 543 vertically extends from sixth bore 510 to tenth bore 640. A plurality of fifth threads 680 are disposed on the threaded lower end 541 of rod 543 for threadably engaging third threads 540 formed in fifth chamber 520. A plurality of sixth threads 690 are disposed on the threaded upper end 542 of rod 543 for threadably engaging fourth threads 660 formed in tenth bore 640. Rod 543, which may be approximately 5.080 inches long and approximately 0.313 inch in diameter, may be stainless steel heat treated to 37–40 Rockwell "C" hardness.

Figure 4:
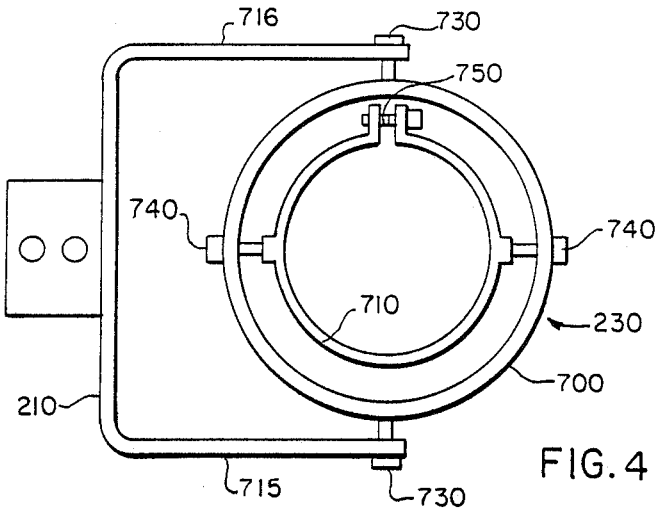
FIG. 4 is a plan view illustrating the double gimbal.
Figure 5:
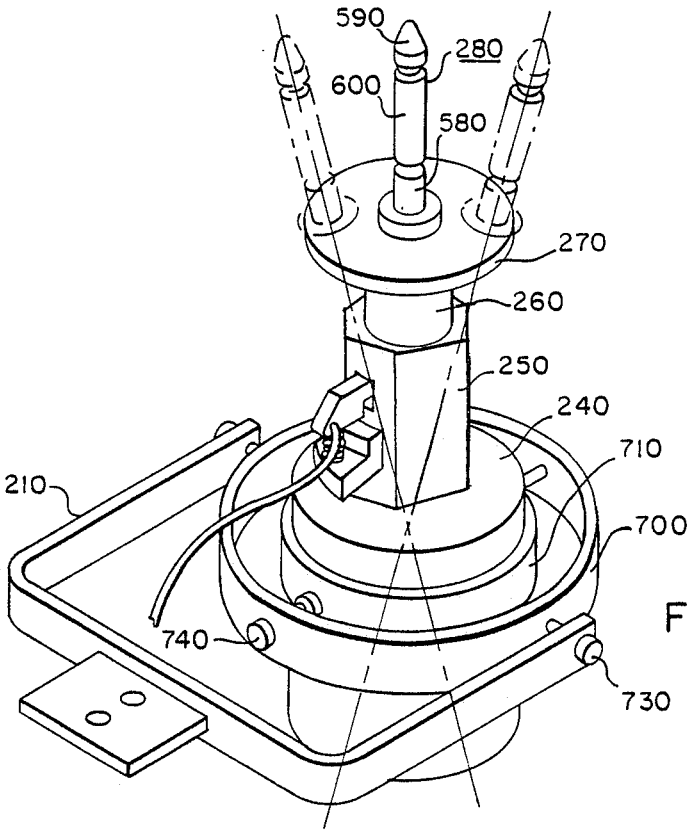
FIG. 5 is a view in perspective of the double gimbal camlock installation assembly generally illustrating the manner in which the double gimbal is capable of pivoting in either of two mutually perpendicular arcs.

Referring now to FIGS. 4 and 5, double gimbal 230, having a first gimbal which may comprise a substantially circular first ring 700 and having a second gimbal which may comprise a substantially circular second ring 710 disposed in first ring 700, is disposed between and connected to a plurality of opposite tines 715 and 716 of fork 210. Fork 210, which is used to urge installation assembly 200 beneath host tube 220 (see FIG. 2), may be aluminum U-shaped member approximately 9.0 inches long and having approximately 3.40 inches between its tines 715 and 716. Double gimbal 230 is used to align camlock mechanism 280 with the vertical axis of host tube 220 (see FIG. 2). Disposed through fork 210 are a plurality of first pivot pins 730 extending through opposite ends of tines 715 and 716 along a first axis disposed in the same plane as fork 210. The circumferential outer edge of first ring 700 is pivotally connected to first pivot pins 730, which may be stainless steel socket head screws, so that the first axis extends through the center of first ring 700. First ring 700 may be aluminum approximately 2.60 inches in inside diameter, approximately 3.20 inches in outside diameter and approximately 0.50 inch in width. Moreover, first ring 700 is connected to first pivot pins 730 such that first ring 700 is capable of pivoting about the first axis in a first arc normal to the plane of ofrk 210 (see FIG. 5). A plurality of second pivot pins 740, which may be stainless steel socket head screws, extend through opposite sides of first ring 700 along a second axis which is normal to the first axis, such that the second axis extends through the center of first ring 700. Pivotally connected to second pivot pins 740 is the circumferential outer edge of second ring 710 which is capable of pivoting about the second axis in a second arc normal to the first arc for vertically aligning and installing camlock mechanism 280 in host tube 220 (see FIG. 5). Attached to second ring 710 is a gimbal tightening means 750 for tightening second ring 710 about housing 240 when housing 240 is disposed in second ring 710. Second ring 710 may be aluminum approximately 1.40 inches in inside diameter and approximately 2.40 inches at its widest outside diameter.

During operation of installation assembly 200, shaft 385 matingly engages fourth bore 445 which matingly engages key 550. Fifth threads 680 which are disposed on the lower portion of rod 543 matingly engage the third threads 540 which are formed in fifth chamber 520. Further, head 560 by key 550 matingly engages sixth chamber 530 which is formed in first sleeve 500. Therefore, when the rotation device (not shown) is actuated, shaft 385 rotates thereby rotating fourth bore 445 which in turn rotates key 550 and head 560. As head 560 rotates, first sleeve 500 rotates. Due to the threaded engagement of third threads 540 formed in fifth chamber 520 with fifth threads 680 disposed on the lower portion of rod 543, rod 543 translates downwardly or upwardly, depending on the direction of rotation of first sleeve 500. When rod 543 translates downwardly, guide 590, which threadably engages the upper portion of rod 543, correspondingly translates downwardly. When guide 590 translates downwardly, it exerts a downward force on the top end of second sleeve 600, which downward force is transmitted through second sleeve 600 to the bottom end of second sleeve 600. However, substantial vertical movement of the bottom end of second sleeve 600 is constrained by the first frustoconcial surface 620 of spreader 580. Therefore, as the downward force exerted by guide 590 increases, second sleeve 600 elastically deforms until second sleeve 600 sufficiently grips the inside wall of host tube 220. After rod 543 is translated downwardly a predetermined distance, such that sleeve 600 sufficiently grips the inside wall of host tube 220, the rotation device is deactuated thereby terminating the rotation of first sleeve 500 and the downward translation of rod 543. After termination of the downward translation of rod 543, release 320 is activated so that latch 310 pivots in a manner which disengages tapered end 361 from slot 360 and second groove 450. When tapered end 361 disengages second groove 450 and slot 360, the lower portion of installation assembly 200 may be disengaged from the upper portion of installation assembly 200 and may be moved downwardly when fork 210 is moved downwardly. The lower portion of installation assembly 200 may be then removed from inlet plenum chamber 340, or alternatively from outlet plenum chamber 140, through hole 170 by using the insertion means.

Figure 6:
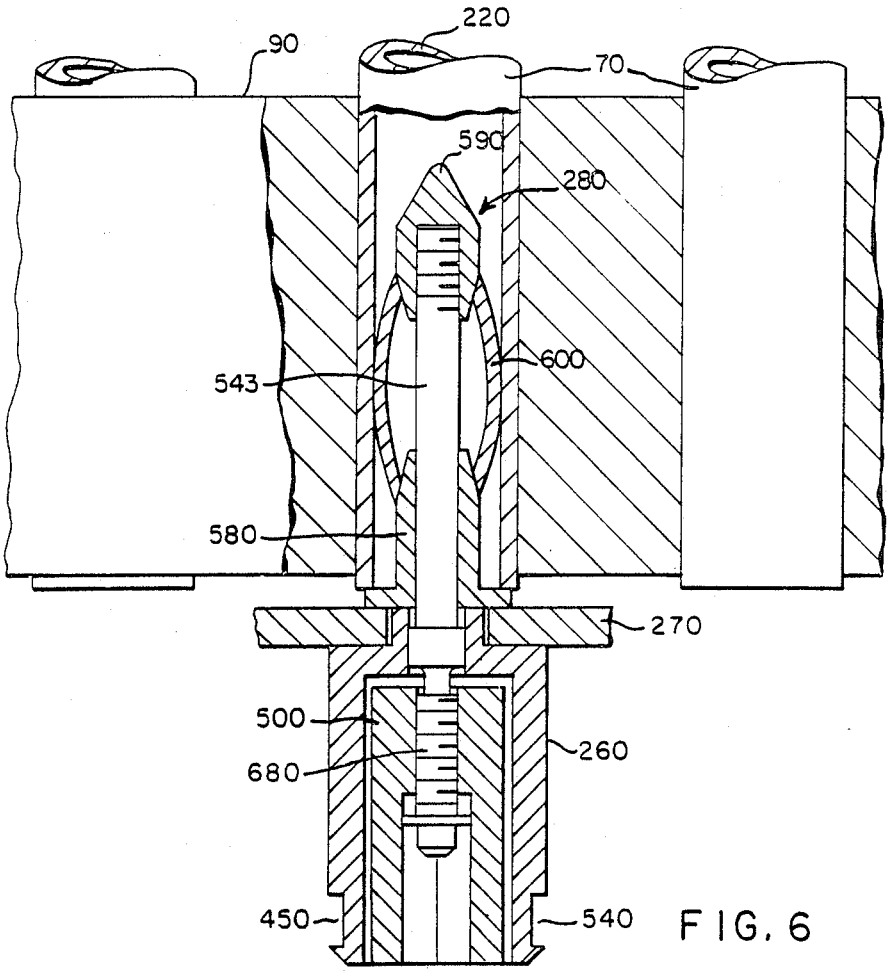
FIG. 6 is a cross-sectional view illustrating the camlock mechanism gripping the inside surface of the host tube.

As shown in FIG. 6, during operation the upper portion of installation assembly 200 is suspended from host tube 220 when rod 543 is translated downwardly the predetermined distance and after the lower portion of installation assembly 200 is disengaged from the upper portion of installation assembly 200. Installation of the upper portion of installation assembly 200 is complete when second sleeve 600 sufficiently grips the inside wall of host tube 220. After second sleeve 600 has sufficiently gripped the inside wall of host tube 300, inspection or repair tools (not shown) are attached to base plate 270 for effectuating inspection of or repairs to tubes 70 or tube sheet 90.

Returning now to FIG. 3, after inspection or repairs have been made to tubes 70 or to tube sheet 90 and the inspection or repair tools are removed from base plate 270, the lower portion of installation assembly 200 is reinserted into inlet plenum chamber 130, or alternatively into outlet plenum chamber 140, through hole 170. The lower portion of installation assembly 200 is then reengaged with the upper portion of installation assembly 200 such that tapered end 361 engages second groove 450. When the rotation device (not shown), which may be a reversible motor, is reactuated, shaft 385 rotates thereby rotating fourth bore 445 which in turn rotates key 550 and first sleeve 500. First sleeve 500 is rotated such that rod 543 translates upwardly due to the engagement of the third threads 540 formed in fifth chamber 520 with the fifth threads 680 disposed on the lower portion of rod 543. Rod 543 is translated upwardly so that second sleeve 600 substantially returns to its pre-deformed shape. After second sleeve 600 substantially returns to its pre-deformed shape, installation assembly 200 is moved vertically downward so that camlock mechanism 280 is removed from host tube 220. Installation assembly 200 is then withdrawn from inlet plenum chamber 130, or alternatively from outlet plenum chamber 140, through hole 170 by using the insertion means.

Consequently, when a tube 70 or tube sheet 90 requires inspection or repair, steam generator 20 is drained of primary and secondary fluid and the installation assembly 200 is introduced into channel head 110 where camlock mechanism 280 is vertically aligned with the selected host tube 220. Double gimbal 230 is used to maintain the camlock mechanism 280 in substantially vertical alignment with the host tube 220. The host tube 220 is selected so that it is located in the neighborhood of the tube 70 or portion of the tube sheet 90 requiring inspection or repair. The installation assembly 200 is used to install the camlock mechanism 280 into the host tube 220 where the second sleeve 600 securely grips the inside of host tube 220 when the rotation device is actuated. The lower portion of the installation assembly 200 is disengaged from the upper portion of the installation assembly 200 to which upper portion the camlock mechanism 280 is attached. The camlock mechanism 280 remains in the host tube 220 due to the gripping action of second sleeve 600. Repair tools (not shown) are then attached to the upper portion of the installation assembly 200 for inspecting or repairing a tube 70 or portion of the tube sheet 90 located in the neighborhood of the host tube 220. After inspection or repair of the tube 70 or tube sheet 90 the lower portion of the installation assembly 200 is reengaged with the upper portion of the installation assembly 200 by reengaging tapered end 361 in second groove 450 and reengaging key 550 into sixth chamber 530. The inspection or repair tools are then detached from the upper portion of the installation assembly 200. Next, the gripping means is disengaged from the host tube 220 by rotating first sleeve 500 in a direction opposite to the initial rotation of first sleeve 500. The installation assembly 200 is then withdrawn from channel head 110 using the insertion means.

Therefore, this invention provides a double gimbal camlock installation assembly having a screw-driven, expandable camlock mechanism for gripping the inside surface of a tubular member, such as a nuclear reaction steam generator tube for effectuating the inspection and repair of steam generator tubes and tube sheets.

What is claimed is:

1. A double gimbal camlock installation assembly comprising:

(a) a camlock mechanism for gripping the inside surface of a vertical tubular member;

(b) a double gimbal connected to the camlock mechanism for vertically aligning the camlock mechanism with said tubular member; and (c) a frame connected to the double gimbal for supporting the double gimbal and for urging the camlock mechanism beneath said tubular member.

2. The double gimbal camlock installation assembly according to claim 1 wherein the frame further comprises a U-shaped fork.

3. The double gimbal camlock installation assembly according to claim 2 wherein the U-shaped fork further comprises a plurality of tines for supporting the double gimbal.

4. The double gimbal camlock installation assembly according to claim 1 wherein the double gimbal further comprises:

(a) a first gimbal pivotally connected on opposite edges thereof to a plurality of tines for vertically aligning the camlock mechanism with said tubular member; and (b) a second gimbal pivotally connected on opposite edges thereof to the first gimbal.

5. The double gimbal camlock installation assembly according to claim 4 wherein the first gimbal further comprises:

(a) a first ring; and (b) a plurality of first pivot pins connected to the first ring for pivotally connecting the opposite edges of the first ring to the tines.

6. The double gimbal camlock installation assembly according to claim 4 wherein the second gimbal further comprises:

(a) a second ring; and (b) a plurality of second pivot pins connected to the second ring for pivotally connecting the opposite edges of the second ring to the first gimbal.

7. A double gimbal camlock installation assembly comprising:

(a) a screw-driven, expandable camlock mechanism having a first sleeve;

(b) an elastically deformable second sleeve connected to said camlock mechanism for gripping the inside surface of a tubular member; and (c) a double gimbal connected to said camlock mechanism for vertically aligning said camlock mechanism with the tubular member.

8. The double gimbal camlock installation assembly according to claim 7 wherein the double gimbal camlock installation assembly further comprises:

(a) a rotation device housing connected to said double gimbal;

(b) a rotation device disposed in said housing; and (c) a shaft connected to said rotation device for actuating said camlock mechanism.

9. The double gimbal camlock installation assembly according to claim 8 wherein the rotation device further comprises a means for reversing direction of its applied torque.

10. The double gimbal camlock installation assembly according to claim 9 wherein the double gimbal camlock installation assembly further comprises a collet mounted on the bottom end of said housing, said collet having a longitudinal first bore therethrough and said housing a second bore associated therewith.

11. The double gimbal camlock installation assembly according to claim 10 wherein the double gimbal camlock installation assembly further comprises:

(a) a bearing disposed in said first bore, said bearing mounting on the top of said housing, and said bearing having a third bore therethrough; and (b) a connector disposed in said third bore, said connector mounted on the top of said housing, and said connector having a fourth bore therethrough for mattingly engaging said shaft.

12. The double gimbal camlock installation assembly according to claim 11 wherein the double gimbal camlock installation assembly further comprises:

(a) a camlock base mounted on the top of said bearing, said camlock base having a fifth bore therethrough;

(b) a first sleeve disposed in said fifth bore, said first sleeve having a sixth bore therethrough; and (c) a key extending from said fourth bore to said sixth bore, said key matingly engaging said fourth bore and said sixth bore for connecting said connector and said first sleeve.

13. The double gimbal camlock installation assembly according to claim 12 wherein the double gimbal camlock installation assembly further comprises a means for releasibly connecting said camlock base and said collet.

14. The double gimbal camlock installation assembly according to claim 13 wherein the double gimbal camlock installation assembly further comprises a base plate having the camlock mechanism mounted thereon, said base plate mounted on the top of said camlock base and attached thereto, and said base plate having a seventh bore therethrough for engaging the top end of said camlock base.

15. The double gimbal camlock installation assembly according to claim 14 wherein the double gimbal camlock installation assembly further comprises a screwthreaded rod extending from said sixth bore to said camlock mechanism and engaging said first sleeve and said camlock mechanism for elastically deforming said second sleeve.

16. The double gimbal camlock installation assembly according to claim 10 wherein the collet further comprises:

(a) an elongated, generally hexagonally-shaped first member mounted on the top of said housing, said first member having the first bore therethrough, and said first bore having a circumferential first groove formed in the lower portion thereof; and (b) said first bore having a plurality of first threads disposed in the lower portion thereof, said first threads extending from the bottom end of said first groove to the bottom end of said first bore.

17. The double gimbal camlock installation assembly according to claim 11 wherein the bearing further comprises a generally cylindrical, vertical second member for engaging said collet.

18. The double gimbal camlock installation assembly according to claim 10 wherein the housing further comprises:

(a) a generally cylindrical, vertical third member, said third member mounted on the bottom end of said collet;

(b) a generally cylindrical first top post formed on the top end of said third member and recessed from the marginal edge of said third member for matingly engaging said first bore;

(c) said first top post having a plurality of second threads formed on the external surface thereof for threadably engaging said first threads; and (d) said first top post having a longitudinal second bore therethrough for receiving said shaft.

19. The double gimbal camlock installation assembly according to claim 8 wherein said shaft is generally cylindrical and vertical.

20. The double gimbal camlock installation assembly according to claim 11 wherein said connector is generally cylindrical and vertical, said connector disposed in the third bore.

21. The double gimbal camlock installation assembly according to claim 14, (a) wherein said camlock base is elongated and generally hexagonally-shaped; and (b) wherein said camlock base further comprises a generally cylindrical second top post formed on the top end of said camlock base, said second top post recessed from the marginal edge of said camlock base for matingly engaging the seventh bore.

22. The double gimbal camlock installation assembly according to claim 12 wherein said first sleeve is generally cylinrdical and vertical.

23. The double gimbal camlock installation assembly according to claim 12, (a) wherein said key is generally cylindrical and vertical, said key having splines formed thereon for matingly engaging the fourth bore;

(b) said key having an elongated, hexagonally-shaped head for matingly engaging the sixth bore; and (c) said key extending from the fourth bore into the fifth bore.

24. The double gimbal camlock installation assembly according to claim 14 wherein said base plate is generally circular and horizontal, the seventh bore transversely extending through said base plate for engaging said camlock base.

25. The double gimbal camlock installation assembly according to claim 14 wherein the camlock mechanism further comprises:

(a) a generally cylindrical, vertical spreader having a first frusto-conical surface formed in the top surface thereof, said spreader mounted on the top of said base plate, and said spreader having a longitudinal, eighth bore therethrough;

(b) a generally cylindrical, vertical second sleeve mounted on the top surface of said spreader, said second sleeve having a ninth bore therethrough, said second sleeve having a beveled first edge on the lower end thereof for matingly engaging said first frusto-conical surface, and said second sleeve having a beveled second edge on the upper end thereof;

(c) a generally cylindrical, vertical guide having a second frusto-conical surface formed in the bottom surface thereof for matingly engaging the beveled second inside surface, said second surface vertically extending from the first frusto-conical surface to the second frustoconical surface, said guide having a longitudinal, wellshaped tenth bore therein, and said tenth bore having a plurality of fourth threads.

26. The double gimbal camlock installation assembly according to claim 15 wherein said screw-threaded rod is generally cylindrical and vertical, said rod having a plurality of fifth threads formed on the lower portion thereof for threadably engaging the sixth bore and having a plurality of sixth threads formed on the upper portion thereof for matingly engaging said camlock mechanism.

27. The double gimbal camlock installation assembly according to claim 13 wherein said means for releasibly connecting said camlock base and said collet further comprises:

(a) a generally horizontal leg, said horizontal leg capable of relasibly connecting said camlock base and said collet;

(b) a generally vertical leg attached to said horizontal leg, said horizontal leg and said vertical leg defining an inverted generally L-shaped latch;

(c) a helically-wound, vertical, elastic spring having an upper portion thereof connected to said vertical leg of said latch, said spring capable of elastically deforming for providing an elastic springing action to said latch;

(d) a latch retainer having one portion thereof connected to said spring and having another portion thereof connected to said collet for providing rigid support to said spring;

(e) a latch release having one end thereof connected to said vertical leg; and (g) means connected to the other end of said latch release for biasing said latch release in a direction to engage or disengage said camlock base and said collet.

* * * * *